US007753703B2

(12) United States Patent
Liao et al.

(10) Patent No.: US 7,753,703 B2
(45) Date of Patent: Jul. 13, 2010

(54) INSULATIVE HOUSING FOR CONFIGURING SOCKET CONNECTOR HAVING PIVOTALLY MOUNTED CLIP

(75) Inventors: Fang-Chu Liao, Tu-cheng (TW); Shuo-Hsiu Hsu, Tu-cheng (TW)

(73) Assignee: Hon Hai Precision Ind. Co., Ltd, Taipei Hsien (TW)

( * ) Notice: Subject to any disclaimer, the term of this patent is extended or adjusted under 35 U.S.C. 154(b) by 0 days.

(21) Appl. No.: 12/284,377

(22) Filed: Sep. 22, 2008

(65) Prior Publication Data

US 2009/0081894 A1 Mar. 26, 2009

(30) Foreign Application Priority Data

Sep. 22, 2007 (CN) ..... 2007 2 0044134

(51) Int. Cl.
*H01R 13/15* (2006.01)
*H01R 13/62* (2006.01)

(52) U.S. Cl. ..... 439/261

(58) Field of Classification Search ..... 439/355, 439/357, 358, 377, 68, 70, 71, 73, 261, 66, 439/259, 675; 361/704
See application file for complete search history.

(56) References Cited

U.S. PATENT DOCUMENTS 6,724,628 B2 * 4/2004 Franz et al. ..... 361/704
6,811,408 B2 * 11/2004 Achammer et al. ..... 439/66
6,829,146 B2 * 12/2004 Franz et al. ..... 361/704
6,970,354 B2 11/2005 Villanueva et al.
6,987,672 B2 * 1/2006 Franz et al. ..... 361/704
7,044,746 B2 5/2006 Copper et al.
7,121,858 B2 * 10/2006 Chen ..... 439/259
7,207,808 B2 4/2007 Ma
7,494,357 B2 * 2/2009 Chen et al. ..... 439/259

* cited by examiner

*Primary Examiner*—Chandrika Prasad
(74) *Attorney, Agent, or Firm*—Andrew C. Cheng; Wei Te Chung; Ming Chieh Chang

(57) ABSTRACT

A socket connector (1) is provided with a pair of clips (13) on perimeter sidewalls (12) for providing sustain retention force to a packaged processor (2) independent from retention force applied to the heat sink so that forces applied to the heat sink are counteracted to reduce the risk of inadvertent processor removal or damage. While pressing portions (133) of the clips (13) are exerted a substantially downward vertical force by a user, the clips (13) are opened for receiving the packaged processor (2). After the user stop pressing the pressing portions (133), the resilient force of the clips (31) push the latching portions (131) fixing on the side edge of the packaged processor (2) for performing the aforementioned purpose.

1 Claim, 7 Drawing Sheets

INSULATIVE HOUSING FOR CONFIGURING SOCKET CONNECTOR HAVING PIVOTALLY MOUNTED CLIP

BACKGROUND OF THE INVENTION

1. Field of the Invention

The present invention relates in general to the field of processor socket connector, and more particularly to a system and method for retaining a central processing unit in a socket connector.

2. Description of Related Art

As the requirement of operating process and compatible on information handling system grows, corresponding socket connector types always vary as well for complying with types of processors. A land grid array (LGA) socket connector mounted on a motherboard has become a major socket connector in computer market. U.S. Pat. Nos. 7,207,808 issued to Ma on Apr. 24, 2007 and 7,044,746 issued to Copper on May 16, 2006 disclose similar type of LGA socket connectors. Pads of a packaged processor wrap with LGA contact terminals restrained in passageways of an insulative housing of a LGA socket connector for achieving electrical connection between the packaged IC and the motherboard socket connector.

Because operating speed of a new generation processor is growing faster and faster, the heat generated by the processor is raising higher and higher. In order to effectively reduce the surface temperature of the CPU within an acceptable operating range, it is unavoidable (indispensable) to attach a heat sink over an upper surface of the processor for heat dissipation. U.S. Pat. No. 6,970,354 issued to Villanueva on Nov. 29, 2005 discloses a processor socket connector having a group of processor retaining mechanism. Please refer to FIG. 1 and FIG. 2, the processor socket connector fastened on a motherboard 102 comprises processor socket 104 for receiving a processor 106 and surrounded by a processor retaining assembly 110. A retention frame 1102 and a retention cover 1104 configure the retaining assembly 110. A retention frame 1102 couples to a motherboard 102 around the processor socket 104 to support movement of the processor cover 1104 between opened and closed positions. A securing device hinge 1106 rotationally couples the processor cover 1104 to the retention frame 1102 and a curved retention tongue 1108 are pressed by a lever 120 for locking the processor cover 1104 in the closed position to restrict movement of the processor from the socket. A heat sink 112 contacts the processor 106 through an opening 1110 in the processor cover 1104. If the heat sink 112 moves due to forces applied to an information handling system, the forces are translated to the processor 106 by the coupling force of the thermal grease between the heat sink 112 and the processor 106. That is why '354 provides a retaining assembly prevents inadvertent removal of a processor from a processor socket by forces exerted on an information handling system that are translated from a heat sink to the processor by the coupling of thermal grease between the heat sink and the processor.

Although a retaining assembly is able to avoid a processor out of a processor socket while disconnecting a heat sink from an upper surface of a processor having thermal grease therebetween for transmitting heat generated by the processor to heat sink for heat dissipation. However the material of the retaining assembly 110 is made of metal and configured by the retaining frame 1102, retaining cover 1104 and hinge 1106. Therefore, it is desired to offer an improved retainer for simplification of manufacturing process and cost reduction.

BRIEF SUMMARY OF THE INVENTION

Therefore a need has arisen for a method and system which retains a processor in a circuit board socket to counteract forces applied by the heat sink to the processor.

In accordance with the present invention, a method and system are provided which substantially reduce the disadvantages and problems associated with previous methods and systems for retaining an information handling system processor and heat sink in place. A processor retainer assembly provides retention force to the processor independent from retention force applied to the heat sink so that forces applied to the heat sink are counteracted to reduce the risk of inadvertent processor removal or damage.

One example of an important technical advantage is that a processor is positively retained in a circuit board independent from a heat sink to counteract forces applied to the processor by the heat sink through the coupling of thermal grease. Separate processor retention prevents processor movement induced by heat sink movement translated to the processor through thermal grease. For instance, the insulative housing of a socket connector having a base and a plural of perimeter sidewalls extending from the base to define a inner cavity for receiving a packaged IC. The opposite perimeter sidewalls further comprising corresponding rotating clips for attaching to the packaged integrated circuit. The rotating clips can be opened by pressing the pressing portion of the clips or closed by relaxing the same. More importantly, while the clips are in closed positions, the processor and the heat sink can be separated each other without distortion or damage on the processor due to the rotating clips' retention.

Another example of an important technical advantage of the present invention is that a single assembly for simplification of manufacturing process and cost reduction provides an insulative housing and face-to-face rotating clips. Incorporation of the insulative housing and rotating clips in a single assembly not only shrinks the using space, but also reduces the cost of information handling system assembly when compared with assembly of multiple parts. As a result, such advantages are suitable in an application of portable systems, for instance laptop PC, mobile phone or the like.

Other objects, advantages and novel features of the invention will become more apparent from the following detailed description of the present embodiment when taken in conjunction with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE INVENTION

Figure 1:
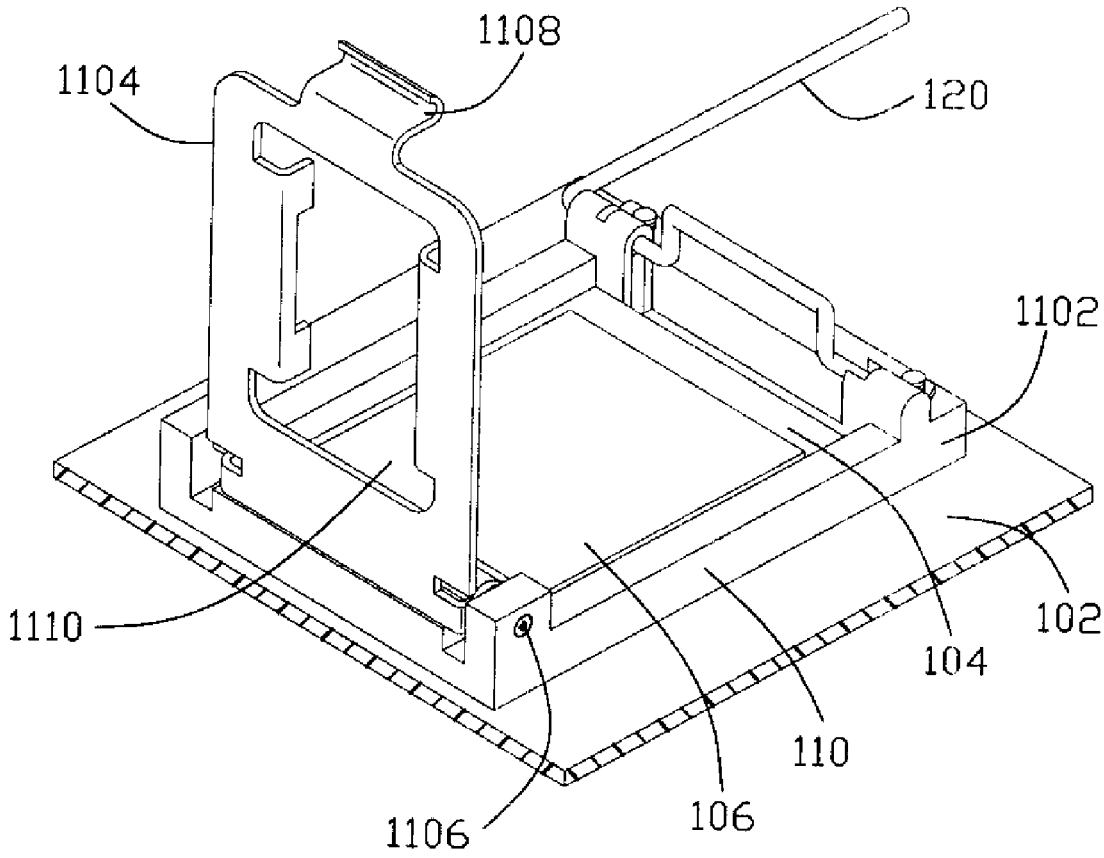
FIG. 1 (PRIOR ART)
FIG. 1 illustrates an isometric view of a conventional socket connector mounted a CPU chip thereon.
Figure 2:
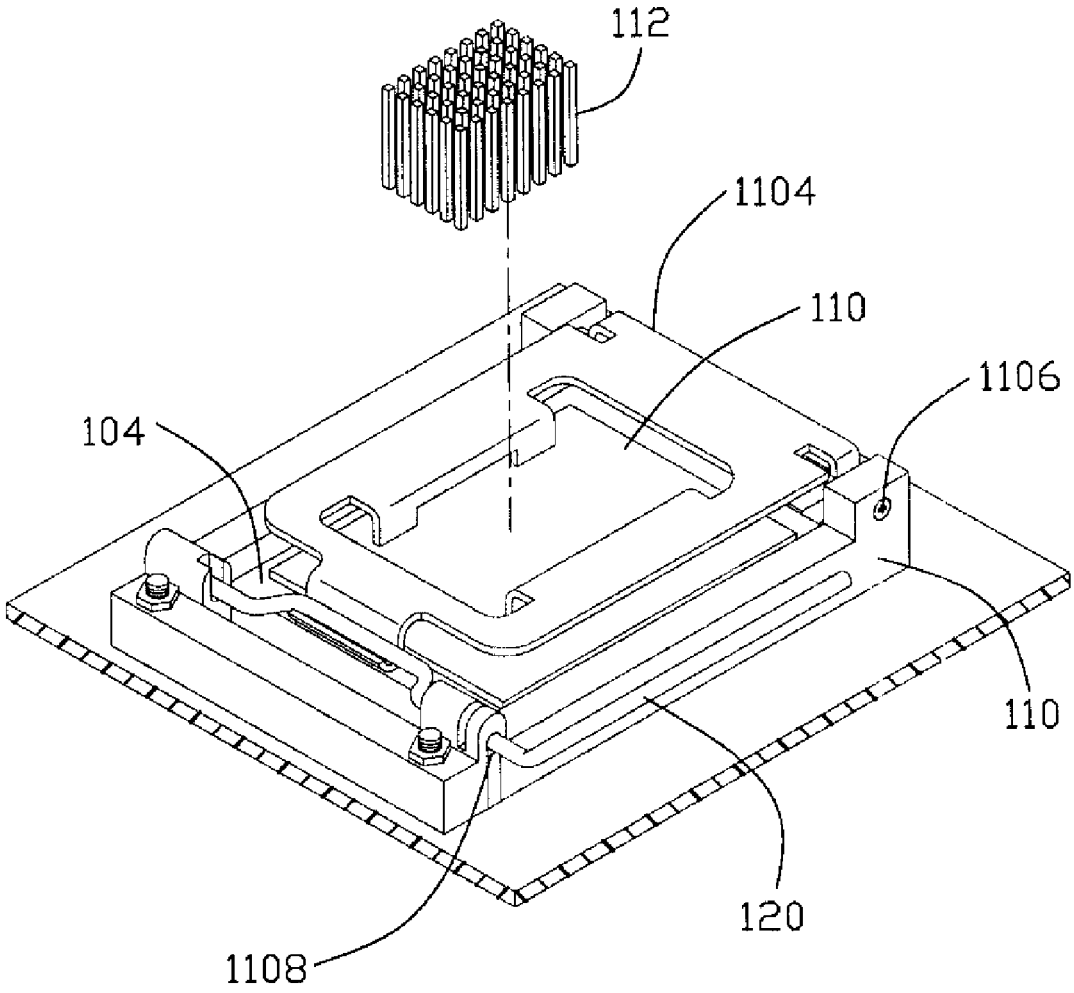
FIG. 2 (PRIOR ART)
FIG. 2 illustrates a combined view of a conventional socket connector mounted a CPU chip thereon shown in FIG. 1 and corresponding heat sink.

While the invention may be susceptible to embodiment in different forms, there is shown in the drawings, and herein will be described in detail, a specific embodiment with the understanding that the present disclosure is to be considered an exemplification of the principles of the invention, and is not intended to limit the invention to that as illustrated and described herein.

Figure 3:
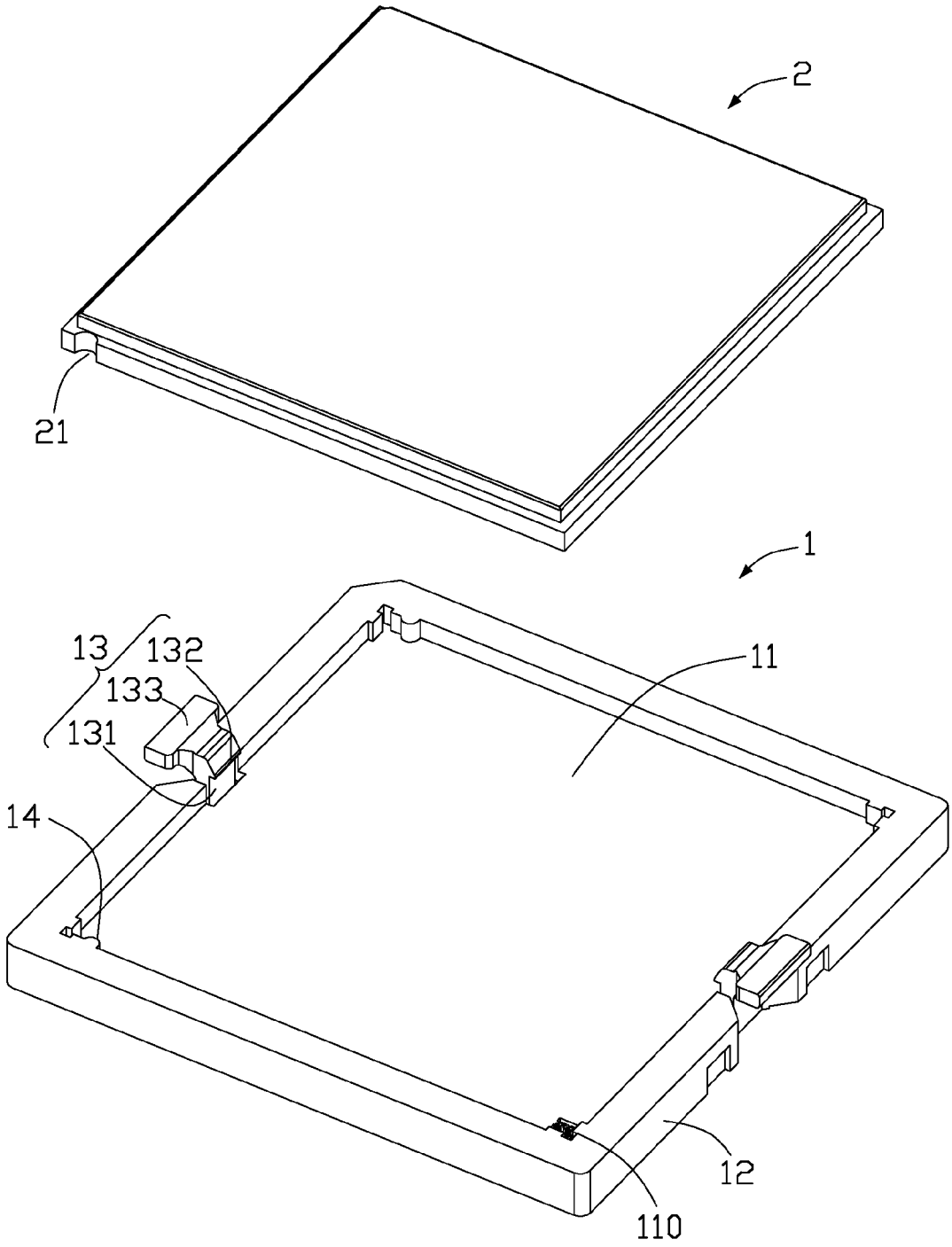
FIG. 3 illustrates an isometric exploded view of an insulative housing of a socket connector and a processor chip according to the preferred embodiment of the present invention.

FIG. 3 illustrates an isometric exploded view of an insulative housing of a socket connector 1 and a processor chip 2 according to the preferred embodiment of the present invention. The socket connector 1 comprises a base 11 and a plurality of perimeter sidewalls 12 extending upward from the base 11 to define an inner cavity for receiving the packaged processor 2. The base 11 has a plurality of passageways 110 penetrating therethough. In addition that, there is at least one pair of rotating clips 13 on opposite perimeter sidewalls 12 for retaining the packaged processor 2, or releasing the same therefrom. The rotating clip 13 may further classified into three portions, the first one is linking portion 131, the second one is latching portion 132 and the final one is pressing portion 133. The linking portion 131 is used for pivotally connecting the rotating clip 13 with the base 11. The latching portion 132 is able to utilize for fixing the packaged processor 2. As for the pressing portion 133, it should be recognized that the pressing portion 133 is for accepting a downward vertical force F to make the clip is in opened condition. As soon as the downward vertical force F is released, the clip 13 would attach both side edges of the packaged processor 2. Consequently, the user may successfully remove heat sink pasted on the upper surface of the packaged processor 2 via thermal grease without risk of the processor out of the socket connector during the heat sink removing process.

Figure 4:
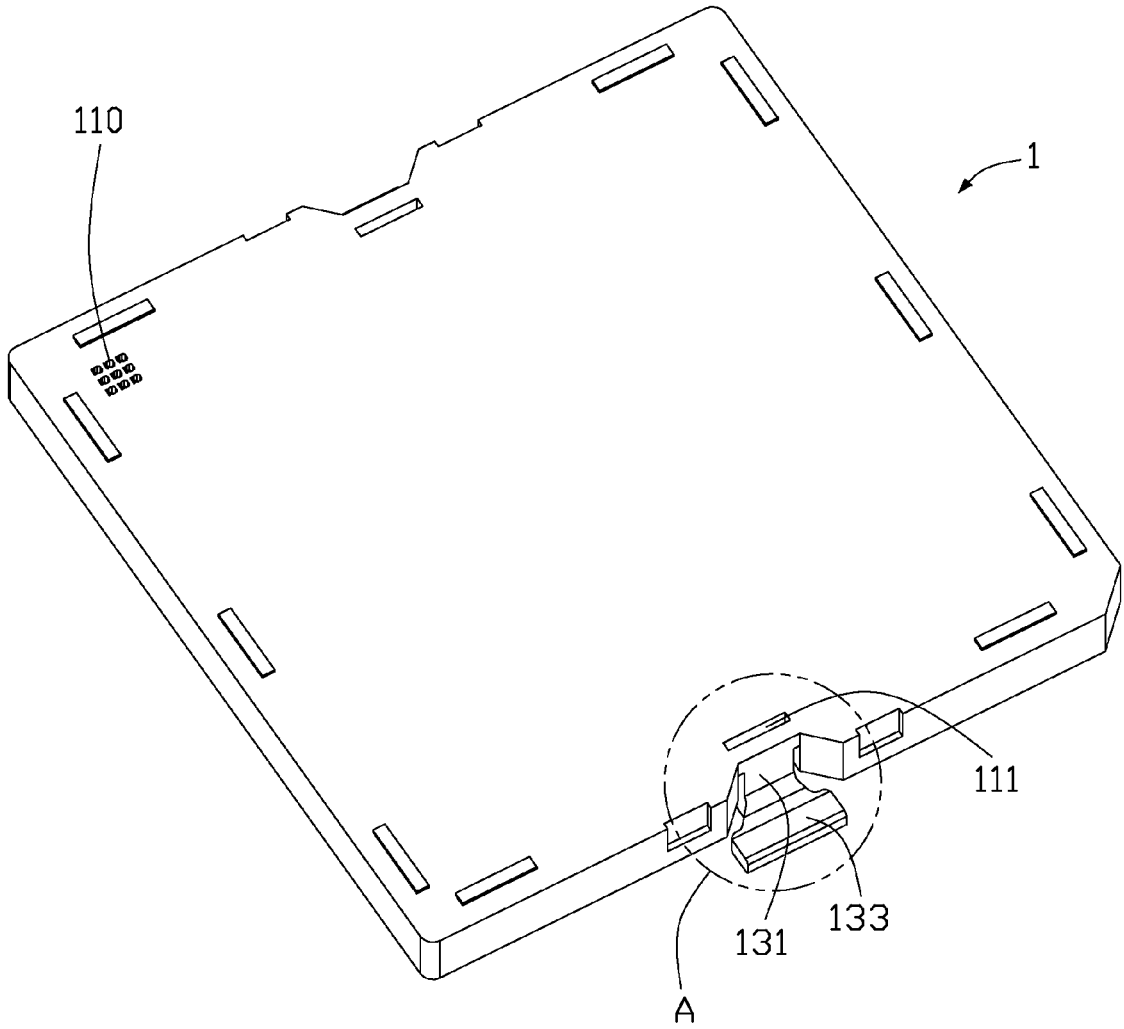
FIG. 4 illustrates a rear view of the insulative housing of the socket connector shown in FIG. 3.
Figure 5:
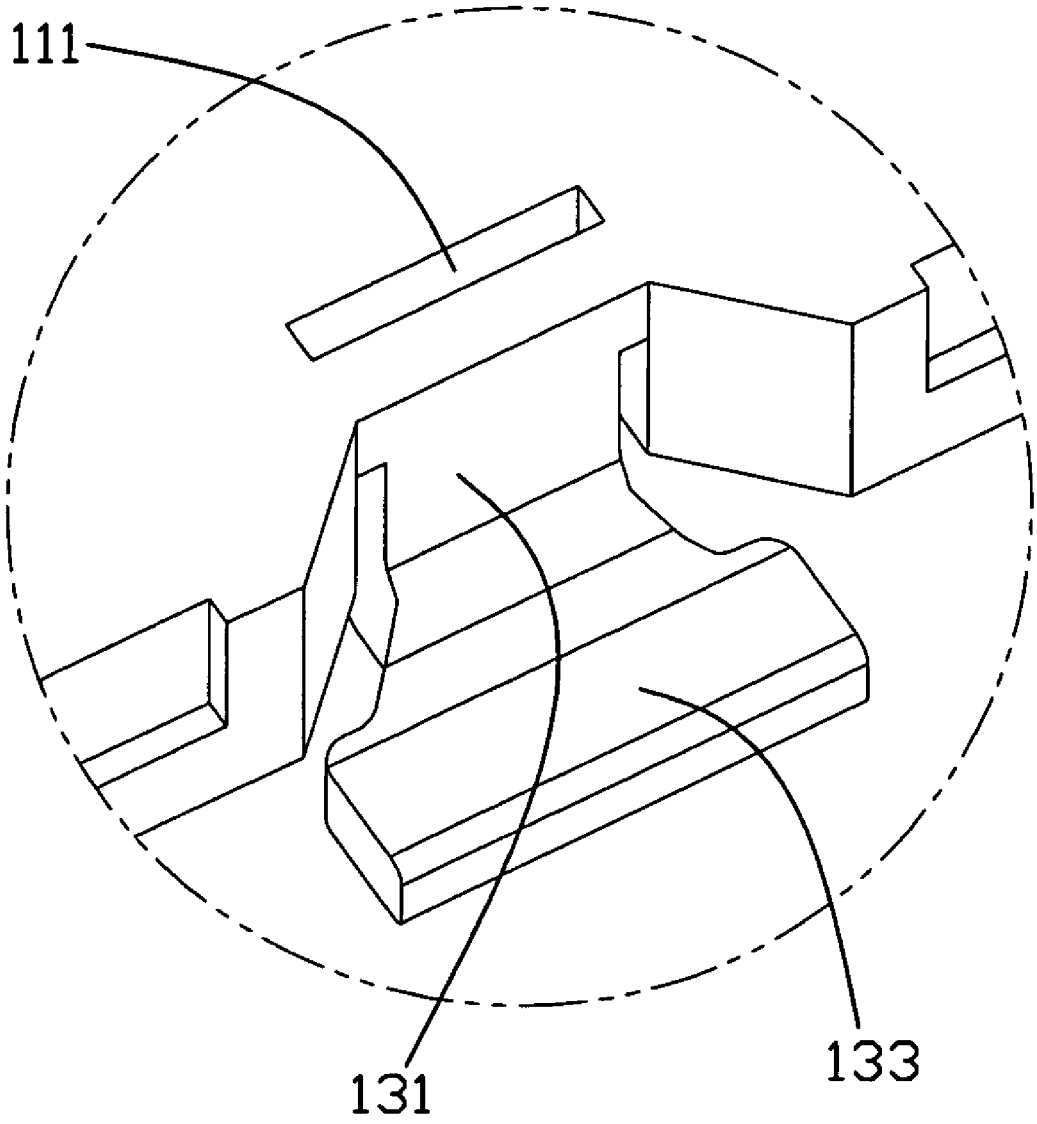
FIG. 5 illustrates an enlarged view of area A shown in FIG. 4.

FIG. 4 displays a rear surface of the insulative housing shown in FIG. 3. FIG. 5 further illustrates an enlarged view of location A shown in FIG. 4. Refer to FIG. 4 and FIG. 5, there are a plurality of blind opening 111 formed on vicinity of side edge of the perimeter sidewalls for releasing the stress resulted from the downward vertical force F exerted on the pressing portions 133 while a user want to open the insulative housing of the socket connector 1.

Figure 6:
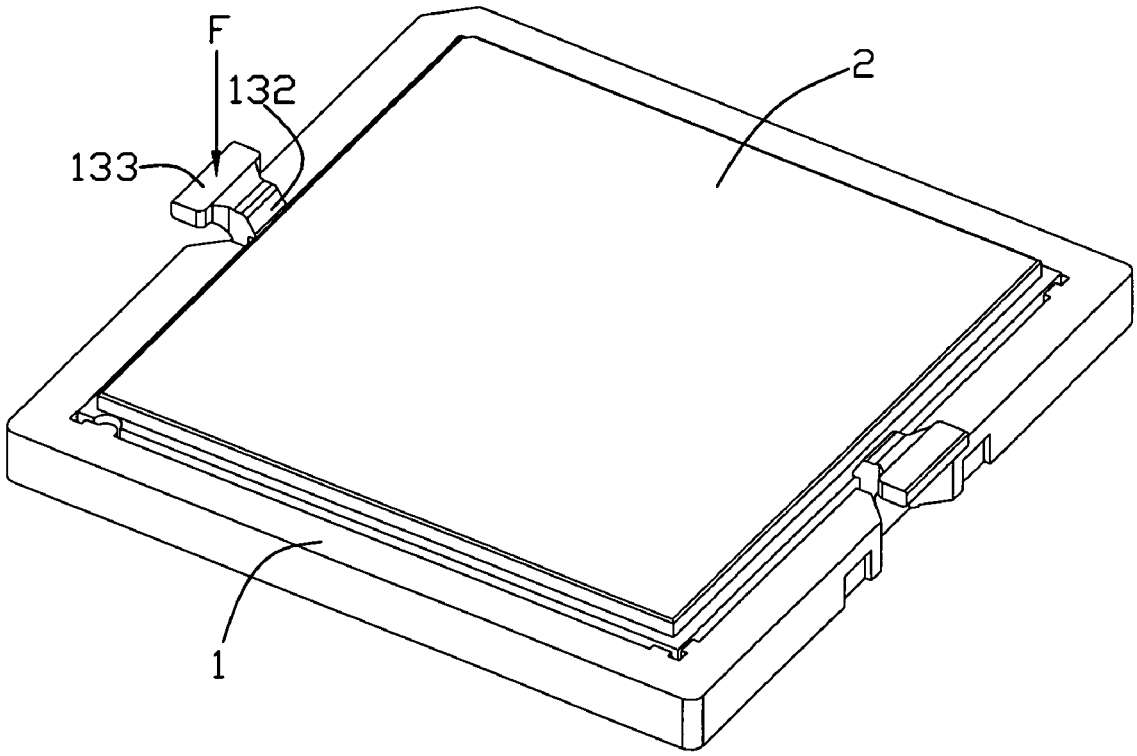
FIG. 6 illustrates a combined view of the socket connector and a CPU chip shown in FIG. 3.

FIG. 6 illustrates an isometric view of the combination of the insulative housing 1 and the packaged processor 2. The orientation of the packaged processor 2 and the insulative housing of the socket connector 1 relies on a guiding recess 21 on a side edge of the packaged processor 2 and a guiding protrusion 14 on an inner side edge of the insulative housing of the socket connector 1 for ensuring the packaged processor 2 is put on the insulative housing in a right orientation. The shape of the guiding protrusion 14 can be any shape, for example bump, semi-columnar, strip, lump, semi-spherical, trapezoid, prism, block or the like.

Figure 7:
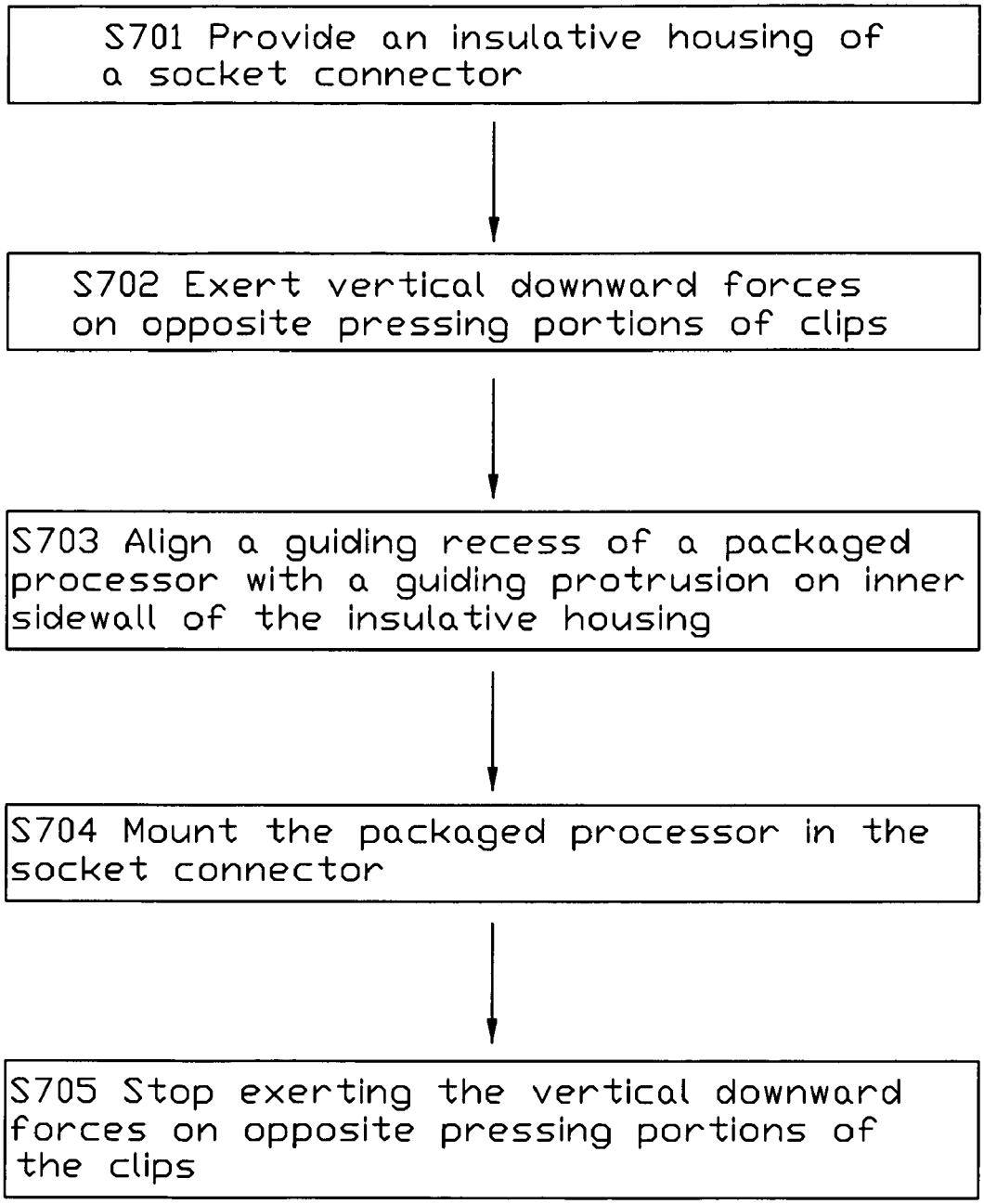
FIG. 7 illustrates a flow chart of assembling a packaged processor in a socket connector in accordance with the preferred embodiment of the present invention.

FIG. 7 illustrates a flow chart for assembling an electrical device in a socket connector according to the preferred embodiment of the present invention. Refer to S701, a user should take a socket connector 1 in accordance with the preferred embodiment of the present invention. In S702, the user exerts vertical downward forces F on opposite pressing portions 133 of clips 133 for preparing to receive a packaged processor 2 in the socket connector 2. After that, S703 illustrates a step of aligning a guiding recess of a packaged processor with a guiding protrusion on inner sidewall of the insulative housing of the socket connector. Furthermore, S704 shows that a user mounts the packaged processor in the socket connector while the socket connector 1 in the opened status. Finally, as shown in S705, the user stop exerting the vertical downward forces F on the opposite pressing portions 133 of the clips 13, then latching portions 132 of the clips 13 consequently latch the side edge of the packaged processor 2 due to resilient forces come from the clips 13.

Although the present invention has been illustrated and described with respect to exemplary embodiment thereof, it should be understood by those skilled in the art that the various changes, omissions and additions may be made therein and thereto without departing from the spirit and scope of the present invention as set forth in the appended claims.

What is claimed is:

1. An electrical connector assembly comprising:

an insulative housing defining a base with a plurality of side walls commonly defining a receiving cavity therein;

a plurality of contacts disposed in the base with contacting sections extending upwardly into the receiving cavity;

a pair of latches located on two opposite side walls in a deflectable manner, each of said latches defining a locking section extending into the receiving cavity and a pressing section extending outwardly away from the receiving cavity opposite to said locking section; wherein said pressing sections extends laterally beyond and upwardly above a contour of said insulative housing beside the corresponding side wall, further including a packaged integrated circuit received in the receiving cavity and directly mechanically and electrically connected to the contacts and directly downwardly pressed by the locking sections of said latches.

* * * * *